US007160170B2

(12) United States Patent
Yoon

(10) Patent No.: US 7,160,170 B2
(45) Date of Patent: Jan. 9, 2007

(54) PANEL-TYPE MAGNETIC TOYS

(75) Inventor: Bong-Seok Yoon, Kyonggi-Do (KR)

(73) Assignee: Magnet 4 U Co., Ltd. (KR)

( * ) Notice: Subject to any disclaimer, the term of this patent is extended or adjusted under 35 U.S.C. 154(b) by 0 days.

(21) Appl. No.: 11/110,438

(22) Filed: Apr. 20, 2005

(65) Prior Publication Data

US 2006/0240737 A1 Oct. 26, 2006

(51) Int. Cl.
*A63H 33/04* (2006.01)

(52) U.S. Cl. ..... 446/92; 446/85; 446/129; 273/156

(58) Field of Classification Search ..... 446/85, 446/92, 129, 131–135; 273/156
See application file for complete search history.

(56) References Cited

U.S. PATENT DOCUMENTS 2,795,893 A * 6/1957 Vayo ..... 446/92
3,724,110 A * 4/1973 Meyerson ..... 40/449
3,995,386 A * 12/1976 Salam ..... 40/449
3,998,004 A * 12/1976 Ehrlich ..... 446/92
4,741,534 A * 5/1988 Rogahn ..... 273/157 R
5,411,262 A * 5/1995 Smith ..... 273/157 R
5,651,715 A * 7/1997 Shedelbower ..... 446/137
5,746,638 A * 5/1998 Shiraishi ..... 446/92
6,024,626 A * 2/2000 Mendelsohn ..... 446/92
6,431,936 B1 * 8/2002 Kiribuchi ..... 446/92
6,749,480 B1 * 6/2004 Hunts ..... 446/92
6,969,294 B1 * 11/2005 Vicentelli ..... 446/92
2002/0065016 A1 5/2002 Huang

FOREIGN PATENT DOCUMENTS

WO WO 2004/062760 A1 7/2004

* cited by examiner

*Primary Examiner*—Nini F. Legesse
(74) *Attorney, Agent, or Firm*—Michael Best & Friedrich LLP

(57) ABSTRACT

Disclosed herein is a panel-type magnetic toy having compartments where permanent magnets move. The magnetic toy includes a polygonal panel body having a space therein, a plurality of compartments defined in the space of the panel body, and separated from each other by at least one partition wall, and a permanent magnet movably provided in each of the compartments. According to this invention, as the magnets are rolled in the hollow compartments partitioned by the partition walls, attractive force is generated between the magnets of neighboring panels. Thereby, it is possible to connect the panels to each other at various positions. Since the magnets move according to the contact position of the panels, it is possible to manufacture variously shaped structures using a small number of panels, thus increasing creative potential.

4 Claims, 10 Drawing Sheets

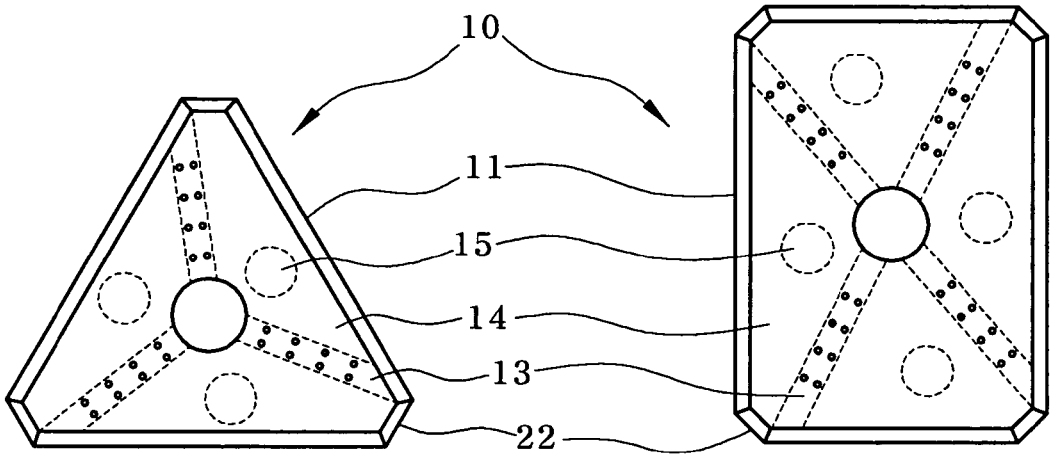
Fig. 11A
Fig. 11B
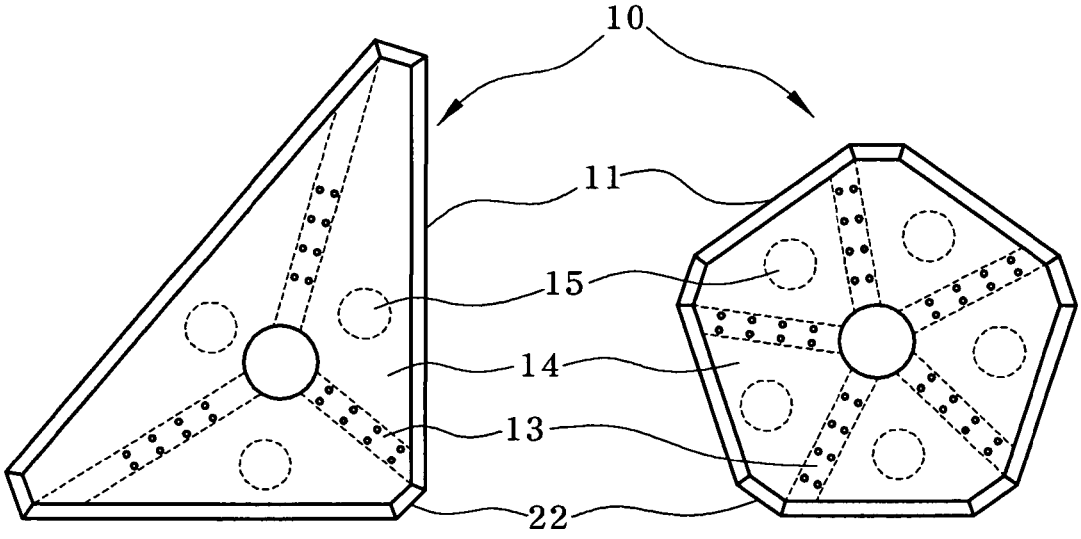
Fig. 11C
Fig. 11D

PANEL-TYPE MAGNETIC TOYS

BACKGROUND OF THE INVENTION

1. Field of the Invention

The present invention relates, in general, to a panel-type magnetic toy, constructed so that permanent magnets move in a plurality of compartments provided in the toy and, more particularly, to a panel-type magnetic toy having a panel which includes a panel body made by combining polygonal upper and lower panel parts with each other, compartments separated from each other by a plurality of partition walls, and spherical magnets freely moving in the compartments. Many panels are continuously connected to each other due to the magnetic force of the magnets moving in the compartments, thus providing variously shaped three-dimensional structures.

2. Description of the Related Art

Generally, a conventional magnetic toy includes cylindrical magnetic rods and metal balls. Each of the magnetic rods is covered with synthetic resin while permanent magnets are provided on opposite ends of the magnetic rod. The metal balls are attached to opposite ends of each magnetic rod, due to the magnetic force of the magnetic rod having the permanent magnets. By continuously coupling a plurality of magnetic rods to the metal balls due to the magnetic force, a desired model or structure is achieved.

A representative magnetic toy is schematically shown in FIG. 1 and FIGS. 2A and 2B.

FIG. 1 is a perspective view to show the assembled state of a conventional magnetic toy, and FIGS. 2A and 2B show the conventional magnetic toy, in which FIG. 2A is a sectional view of a magnetic rod constituting the magnetic toy, and FIG. 2B is a sectional view to show the assembly of the magnetic toy.

As shown in the drawings, the conventional magnetic toy includes cylindrical magnetic rods 4 and metal balls 5, with disc-shaped magnets 2 and 2' provided on opposite ends of each magnetic rod 4. By the magnetic force generated by the magnets 2 and 2', the magnetic rods 4 and the metal balls 5 are continuously connected to each other, thus providing a structure having a desired shape.

Each magnetic rod 4 having a predetermined magnetic force includes a metal pin 1. The disc-shaped magnets 2 and 2' are provided on opposite ends of the metal pin 1. The metal pin 1 equipped with the magnets 2 and 2' is covered with a covering 3 that is made of a hard synthetic resin material. Further, the metal balls 5 are attached to opposite ends of each magnetic rod 4. By continuously attaching other magnetic rods 4' and 4" to the metal balls 5, a linear structure using a plurality of magnetic rods 4 may be manufactured.

Each magnetic rod 4 is constructed so that the disc-shaped permanent magnets 2 and 2' are provided on opposite ends of the metal pin 1. Hence, the magnetic rod 4 itself serves as a bar magnet having a strong magnetic force. In this case, one side of the magnetic rod 4 is the N pole, while the other side of the magnetic rod 4 is the S pole.

The metal balls 5 are connected to the magnetic rods 4, due to the magnetic force acting between the magnetic rods 4 and 4'. That is, when the N pole of one magnetic rod 4 approaches the S pole of another magnetic rod 4', a strong attractive force is generated. By the attractive force, the metal ball 5' is attached between the two magnetic rods 4, thus firmly connecting the magnetic rods 4 to each other. Further, each metal ball 5 serves as a member to connect other magnetic rods to each other.

As shown in FIG. 2B, a triangular connection structure in which each metal ball 5 is attached to the N pole and the S pole of the magnetic rods 4 is the most stable. It is possible to make a large structure based on the triangular connection structure.

Further, when the magnetic toy using the permanent magnets is constructed so that the diameter of each metal ball 5 is larger than that of each magnetic rod 4, a plurality of magnetic rods 4 may be attached to the metal ball 5 at angular intervals from about 45° to about 180°. Thus, it is possible to provide various angles to a structure in a radial direction as well as in vertical and horizontal directions. Further, a plurality of metal balls 5 is attached to a single magnetic rod 4, so that it is possible to manufacture a rotary structure using the point contact of the metal balls 5.

However, the conventional magnetic toy is problematic in that it provides only a linear structure using the magnetic rods 4, so that it is difficult to impart accurate shape to a structure which is manufactured using a plurality of magnetic rods 4 and metal balls 5. Further, when a sophisticated structure is manufactured, many triangular structures are required to securely support the sophisticated structure. Thus, the conventional magnetic toy is problematic in that it requires a great number of magnetic rods 4 and metal balls 5.

The conventional magnetic toy includes the metal balls serving as points, and the magnetic rods serving as lines. Thus, the magnetic toy is advantageous in that the volume of the toy can be minimized when the toy is stored. Further, since the components of the toy are attached to each other by the permanent magnets, the components are rarely lost. However, the conventional magnetic toy is problematic in that it comprises points and lines only, so that it is difficult to provide various shapes. Further, it is impossible to make a plane.

In order to solve the problems, Korean Patent Appln. No. 10-2005-14644 has been proposed, which was filed on Feb. 22, 2004 by the inventor of this invention and is titled "magnetic puzzle". The construction of the magnetic puzzle will be described briefly with reference to FIGS. 3A and 3B.

FIGS. 3A and 3B show the conventional panel-type magnetic toy. As shown in the drawings, the toy has the shape of a panel whose width and length are larger than its height. The toy comprises a plurality of puzzle pieces 30. Each puzzle piece 30 includes a panel body 31 having along an edge thereof at least one magnet moving space R. Further, a magnet 32, 33 is movably provided in the magnet moving space R.

However, the conventional magnetic puzzle is problematic in that the magnet moving spaces are formed only at side surfaces and corners of the panel body 31, so that the magnet moving course is restricted. Thereby, it is difficult to firmly couple the face of one puzzle piece 30 to the face of another puzzle piece 30 or the side of one puzzle piece 30 to the side of another puzzle piece 30.

Further, another conventional magnetic toy is disclosed in PCT WO 2004/062760, which was published on Jul. 29, 2004 and is titled "JOINING APPARATUS WITH ROTATABLE MAGNET THEREIN AND BUILT-UP TYPE TOY WITH THE SAME". According to the document, the conventional magnetic toy is provided with a plurality of polyhedral parts. Each of the polyhedral parts has magnets on joining surfaces. The magnet provided on a joining surface of one polyhedral part is attracted to the magnet provided on a joining surface of another polyhedral part, so that the polyhedral parts are joined to each other.

The conventional magnetic toy is problematic in that it is possible to join the polyhedral parts together using magnetic force, only when the magnets of the polyhedral parts are arranged so that attractive force acts between a magnet provided on a joining surface of one polyhedral part and a magnet provided on a joining surface of another polyhedral part. Further, since the magnet is very small in comparison with the size of a main body of the polyhedral part, the magnetic force joining the polyhedral parts is weak.

The conventional magnetic toy is constructed so that each magnet is rotatable in a magnet holding portion to change the polarity. However, the conventional magnetic toy is problematic in that only the polarity of each magnet is changed, but the position of the magnet is not changed, so that the above-mentioned problems are not solved. Further, the conventional magnetic toy has a drawback in that it is difficult to manufacture the polyhedral part having the rotatable magnet on the junction surface, thus decreasing work efficiency.

SUMMARY OF THE INVENTION

Accordingly, the present invention has been made keeping in mind the above problems occurring in the prior art, and an object of the present invention is to provide a panel-type magnetic toy, having a panel body made by combining polygonal upper and lower panel parts with each other, hollow compartments provided in the panel body and partitioned from each other by partition walls that are formed by coupling radial ribs of the upper and lower panel parts to each other, and permanent magnets put into the corresponding compartments of the panel body and rolling due to external magnetic force or gravity. As the magnets roll in the hollow compartments due to the external magnetic force or gravity, an attractive force is generated between neighboring panels, thus allowing the side of one panel to be connected to the side of another panel. In this way, many panels can be continuously connected to each other.

Another object of the present invention is to provide a panel-type magnetic toy, having a plurality of protrusions and holes that are provided on an outer surface of each of a plurality of partition walls which partition a panel body into a plurality of hollow compartments, and are arranged parallel to each other. Thus, the protrusions of one panel are fitted into the corresponding holes provided on the surface of another panel, thus allowing the face of one panel to be connected to the face of another panel.

In order to accomplish the above objects, the present invention provides a panel-type magnetic toy, including a panel body which is made by combining polygonal upper and lower panel parts with each other and has partition walls formed by coupling ribs of the upper and lower panel parts to each other, hollow compartments separated from each other by the partition walls, and permanent magnets put into the compartments and rolling due to external magnetic force or gravity.

An opening is provided on each side surface of the panel body, excluding a portion corresponding to an outside end of each rib. The opening provides a gap between the upper and lower panel parts constituting a sidewall of each of the compartments which are separated from each other by the partition walls, thus allowing the magnetic force of a magnet moving in each compartment to act on an exterior.

The ribs provided on facing surfaces of the upper and lower panel parts are coupled to each other, thus providing the partition walls. The partition walls are radially arranged in the panel body, and define hollow spaces where the magnets move.

Further, protrusions and holes are provided on front and back surfaces of the panel body to be parallel with each other, and are radially arranged along the partition walls. The protrusions and holes allow the face of one panel to be connected to the face of another panel using the front and back surfaces of each panel body.

Furthermore, each side surface of the panel body comprises a flat horizontal contact part, thus allowing the side of one panel body to be horizontally connected to the side of another panel body. Each horizontal contact part extends from a tapered surface provided on an edge of each of the upper and lower panel parts constituting the panel body. Further, the horizontal contact part is bent inwards at an end thereof to be at an acute angle with an inner surface of the panel body.

BRIEF DESCRIPTION OF THE DRAWINGS

The above and other objects, features and advantages of the present invention will be more clearly understood from the following detailed description taken in conjunction with the accompanying drawings, in which:

FIGS. 2A and 2B show the conventional magnetic toy, in which FIG. 2A is a sectional view of a magnetic rod constituting the magnetic toy, and FIG. 2B is a sectional view to show the assembly of the magnetic toy;

FIGS. 10A to 10*c* are perspective views to show various coupling structures of the panel-type magnetic toy of FIG. 4, in which FIG. 10A is a perspective view to show the state where the side of one panel is coupled to the side of another panel, FIG. 10B is a perspective view to show the state where the corner of one panel is coupled to the corner of another panel, and FIG. 10C is a perspective view to show the state where the face of one panel is coupled to the face of another panel;

FIGS. 11A to 11D are front views to show various shapes of panels of the panel-type magnetic toy, according to the present invention;

DESCRIPTION OF THE PREFERRED EMBODIMENTS

The construction and operational effects of a panel-type magnetic toy, according to the present invention, will be described in detail by way of example with reference to the accompanying drawings.

Figure 1:
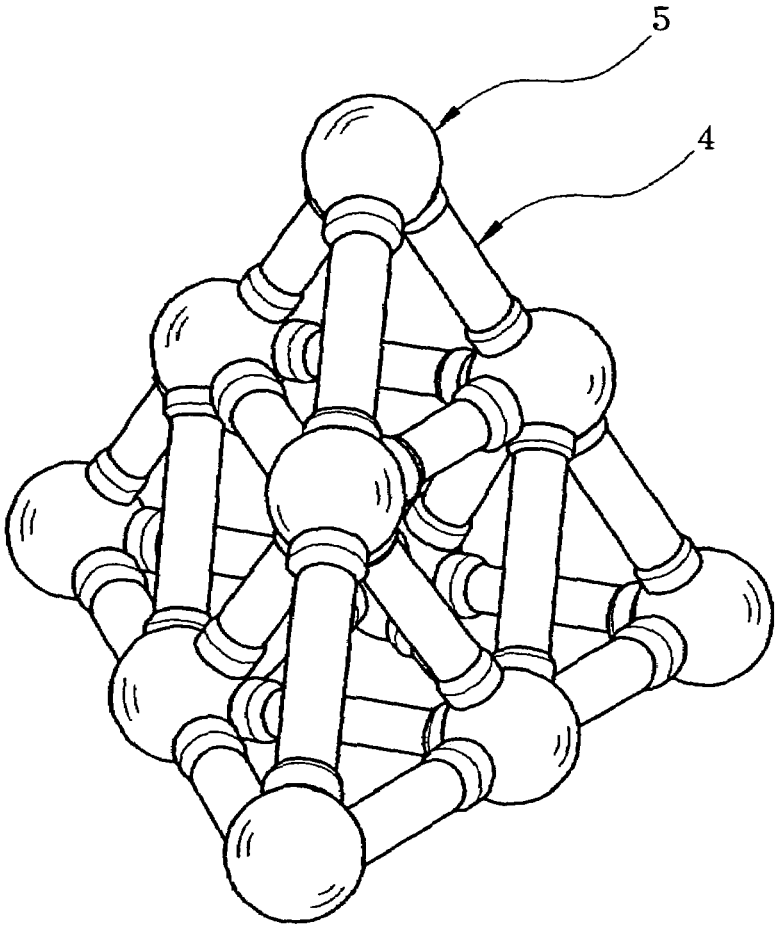
Fig. 1 PRIOR ART
FIG. 1 is a perspective view to show the assembled state of a conventional magnetic toy.
Figure 2A:
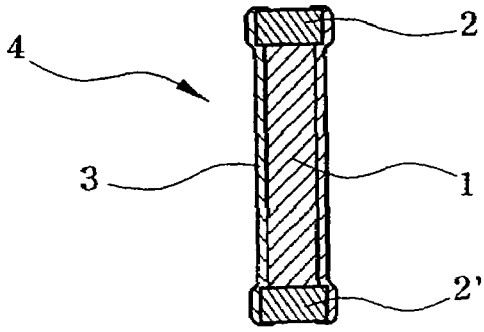
Fig. 2A PRIOR ART
Figure 2B:
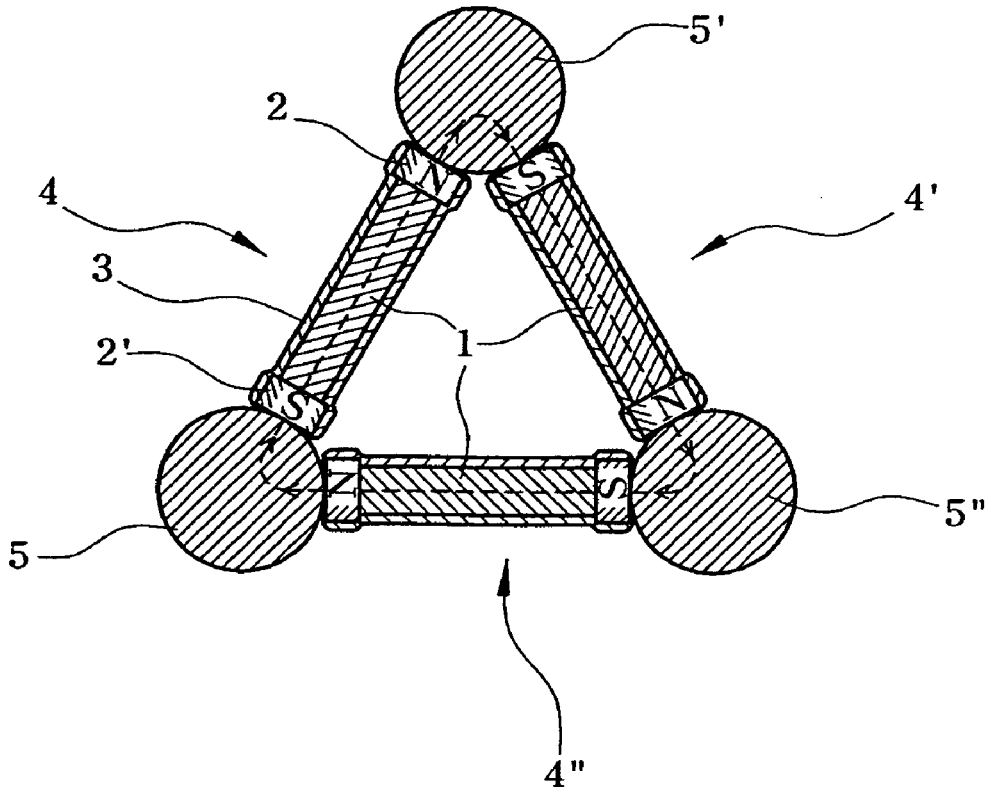
Fig. 2B PRIOR ART
Figure 3A:
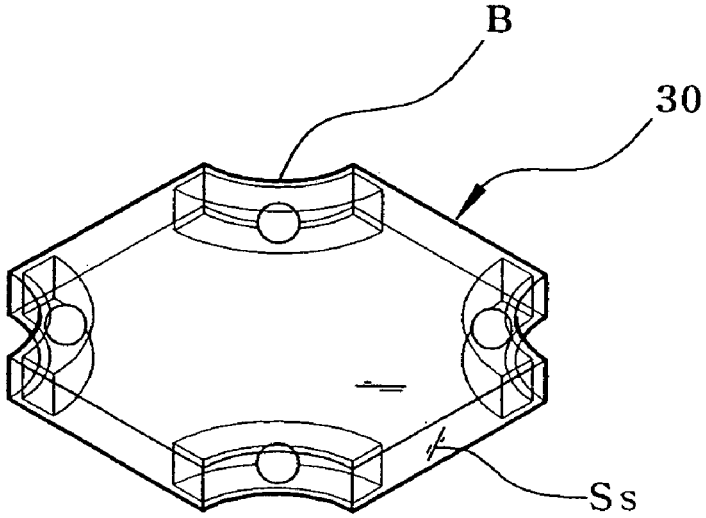
Fig. 3A PRIOR ART
FIGS. 3A and 3B are perspective views of a conventional panel-type magnetic toy.
Figure 3B:
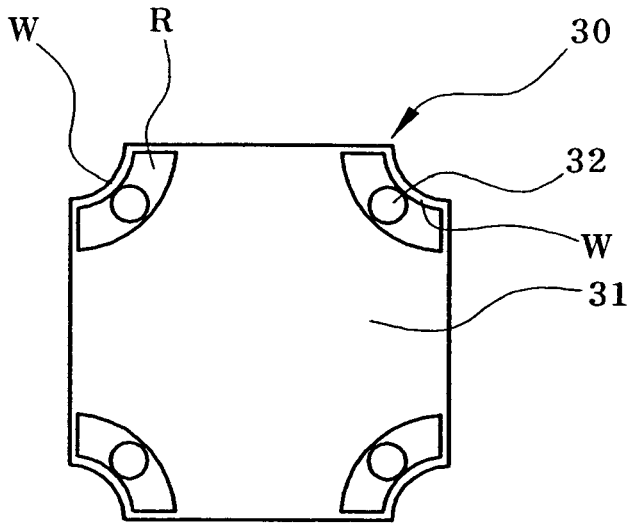
Fig. 3B PRIOR ART
Figure 4:
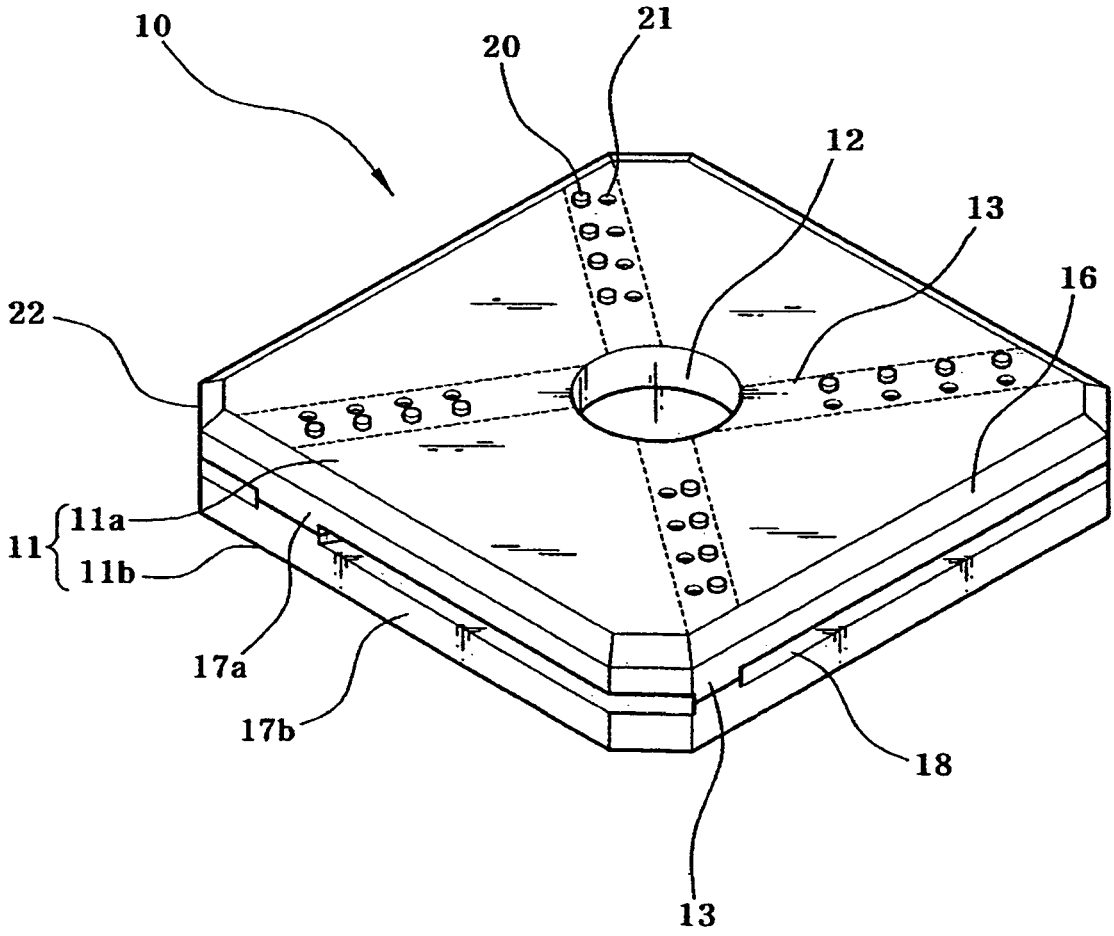
FIG. 4 is a perspective view of a panel of a panel-type magnetic toy, according to an embodiment of the present invention.
Figure 5:
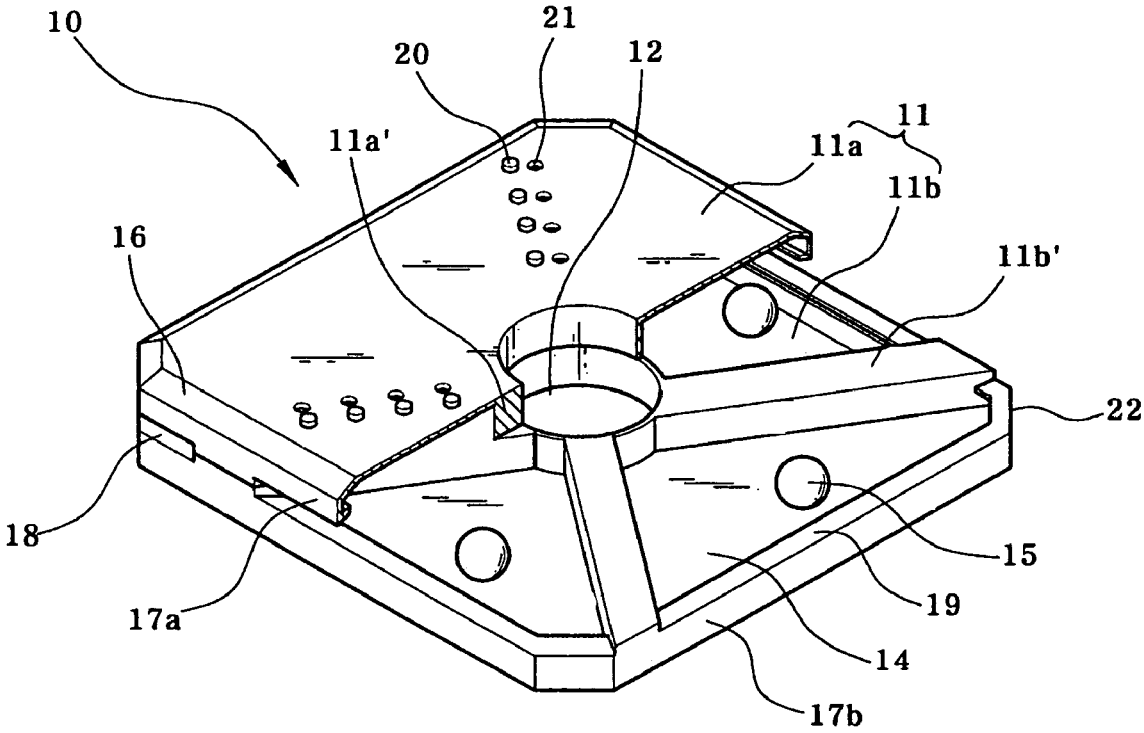
FIG. 5 is a partially cut away perspective view of the panel of FIG. 4.
Figure 6:
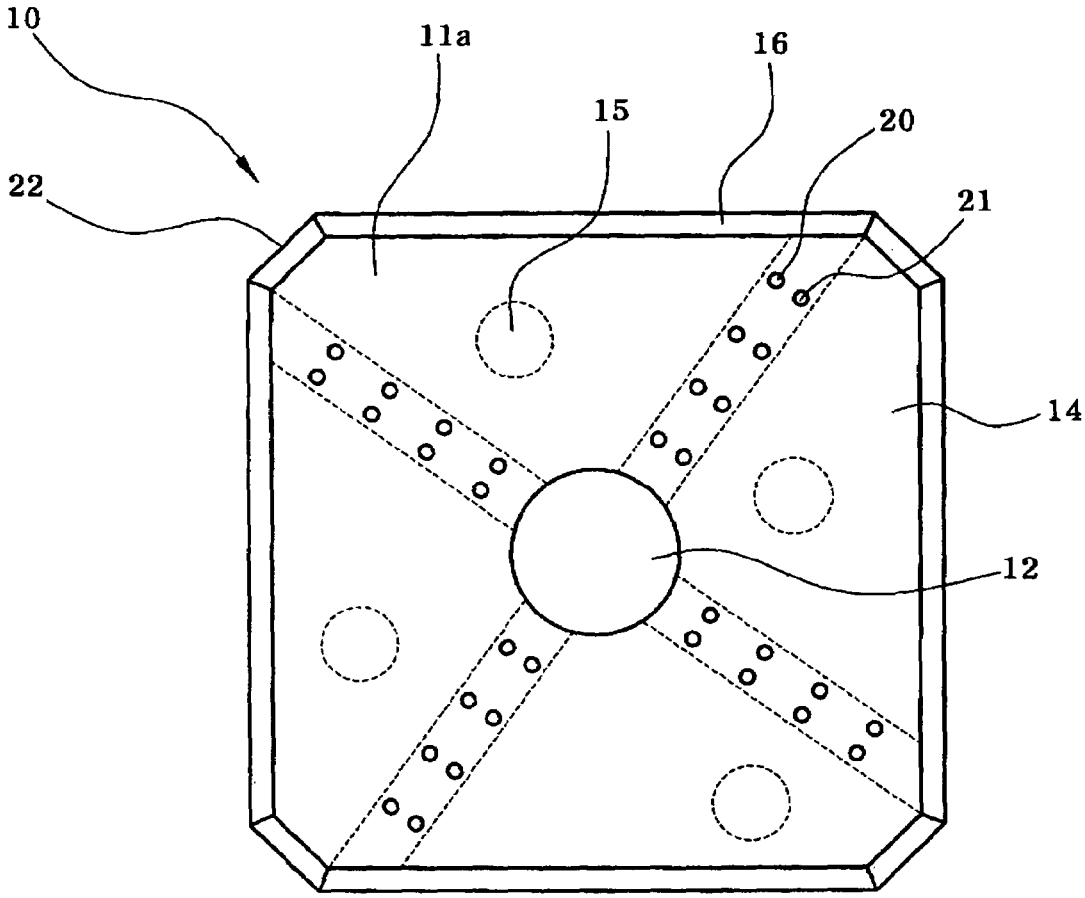
FIG. 6 is a plan view of the panel of FIG. 4.
Figure 7:
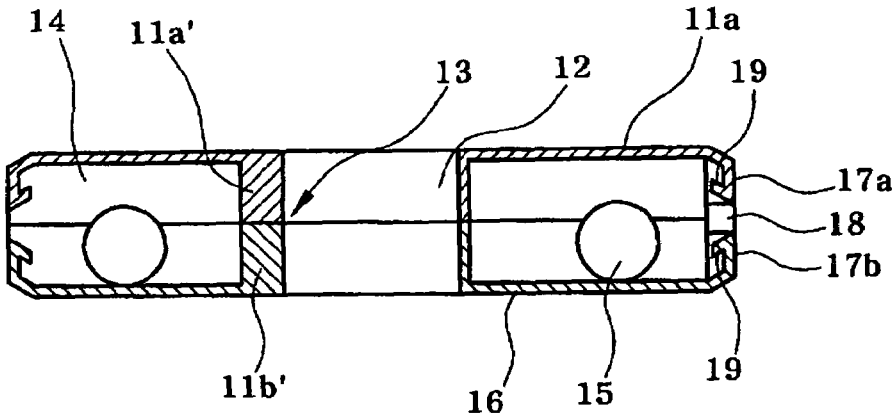
FIG. 7 is a sectional view of the panel of FIG. 4.

FIG. 4 is a perspective view of a panel of a panel-type magnetic toy, according to the present invention, FIG. 5 is a partially cut away perspective view of the panel of FIG. 4, FIG. 6 is a plan view of the panel of FIG. 4, and FIG. 7 is a sectional view of the panel of FIG. 4.

As shown in the drawings, the panel-type magnetic toy according to this invention includes a panel 10 having polygonal upper and lower panel parts 11*a* and 11*b*, hollow compartments 14, and permanent magnets 15. Ribs 11*a*', 11*b*' are radially provided on a surface of each of the upper and lower panel parts 11*a* and 11*b*. The upper and lower panel parts 11*a* and 11*b* are coupled to each other so that the ribs 11*a*' of the upper panel part 11*a* contact the corresponding ribs 11*b*' of the lower panel part 11*b*. Thus, the ribs 11*a*' and 11*b*' provide a plurality of partition walls 13. Further, the hollow compartments 14 are provided in a panel body 11 which is defined by combining the upper and lower panel parts 11*a* and 11*b* with each other. The hollow compartments 14 are separated from each other by the partition walls 13. The permanent magnets 15 are put into the compartments 14 and roll due to external magnetic force or gravity.

The upper and lower panel parts 11*a* and 11*b* are perpendicularly bent at side edges thereof, thus providing horizontal contact parts 17*a* and 17*b*. Further, an edge of each of the horizontal contact parts 17*a* and 17*b* is formed by a tapered surface 16 which is inclined at a predetermined angle. The ribs 11*a*', 11*b*' protrude perpendicularly from an inner surface of each of the upper and lower panel parts 11*a* and 11*b*, and are arranged radially from the center to corners of each of the panel parts 11*a* and 11*b*.

When the upper and lower panel parts 11*a* and 11*b* are combined with each other, the ribs 11*a*' of the upper panel parts 11*a* are coupled to the ribs 11*b*' of the lower panel parts 11*b*, thus providing the partition walls 13 at regular intervals in the panel body 11. Further, the panel body 11 has the hollow compartments 14 therein. Each of the hollow compartments 14 is defined by neighboring partition walls 13 and the horizontal contact parts 17*a* and 17*b* of the upper and lower panel parts 11*a* and 11*b*.

The horizontal contact parts 17*a* and 17*b* are combined with each other, thus providing side surfaces of the panel body 11. Openings 18 are longitudinally provided on the side surfaces of the panel body 11. In a detailed description, each of the openings 18 is provided on a side surface of each compartment 14, excluding a portion corresponding to an outside end of each partition wall 13. Hence, the magnetic force of the magnet 15 moving in each hollow compartment 14 acts on the exterior through the opening 18.

Each opening 18 is defined by bent parts 19 that are inwardly bent at ends of the horizontal contact parts 17*a* and 17*b*. In this case, each of the bent parts 19 is bent at an end of the horizontal contact part 17*a*, 17*b* to be at an acute angle with an inner surface of the horizontal contact part 17*a*, 17*b*. The circumferential surface of the magnet 15 moving in each compartment 14 is seated on a pair of upper and lower bent parts 19.

Further, protrusions 20 and holes 21 are provided on a surface of each of the upper and lower panel parts 11*a* and 11*b* constituting the panel body 11 to be parallel to each other, and are radially arranged along the partition walls 13. Thus, when the face of one panel body 11 is combined with the face of another panel body 11, the protrusions 20 and the holes 21 of one panel body 11 engage with the holes 21 and the protrusions 20 of another panel body 11, thus allowing the panels 10 to be connected to each other in a parallel manner.

A rod insertion hole 12 is bored through the center of the panel body 11, so that a cylindrical rod or a magnetic rod (not shown) is vertically inserted into the rod insertion hole 12. Thereby, it is possible to connect another panel 10 to an end of the magnetic rod. In this way, a plurality of panels 10 can be continuously connected to each other.

Figure 8:
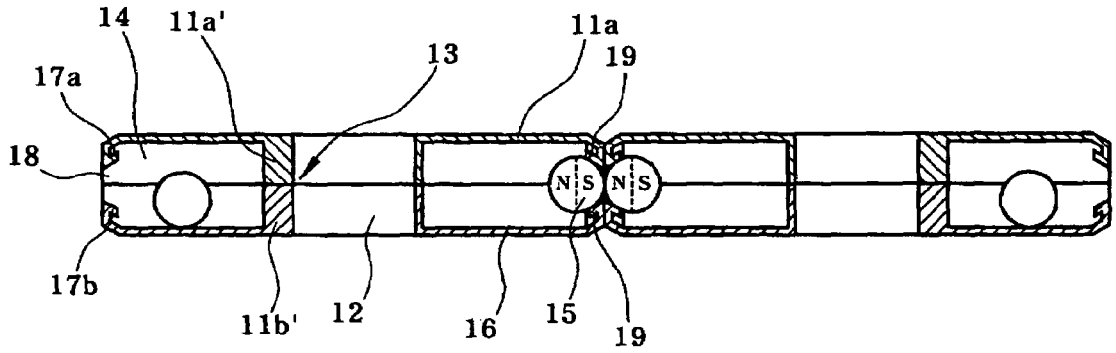
FIG. 8 is a sectional view to show the state where two panels of FIG. 4 are coupled to each other.
Figure 9:
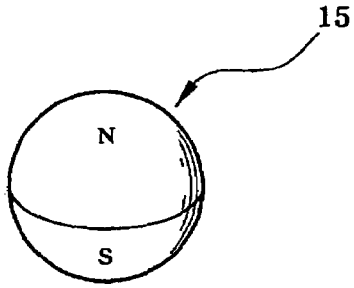
FIG. 9 is a perspective view of a magnet provided in each compartment of the panel of FIG. 4.

FIG. 9 is a perspective view of the magnet provided in each compartment of the panel, according to the present invention. As shown in the drawing, the spherical magnet 15 comprises upper and lower hemispherical parts that are an N pole and an S pole, respectively. Thus, when a magnetic material approaches the spherical magnet 15, the magnet 15 rolls due to the attractive force or the repulsive force, which is generated according to the polarity of the approaching magnetic material. That is, as shown in FIG. 8, when two panels 10 approach each other, the magnets 15 provided in the compartments 14 of adjacent panel bodies 11 roll so that the N pole of one panel body 11 faces the S pole of the other panel 10 due to the attractive force between the magnets 15. Thereby, the side of one panel body 11 can be connected to the side of the other panel body 11, due to the attractive force between the spherical magnets 15.

Figure 10A:
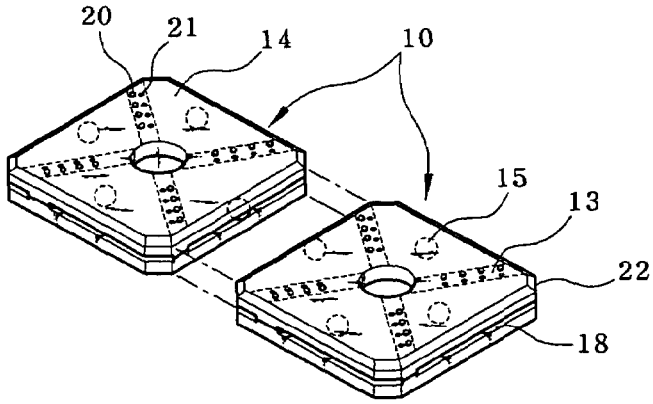
Figure 10B:
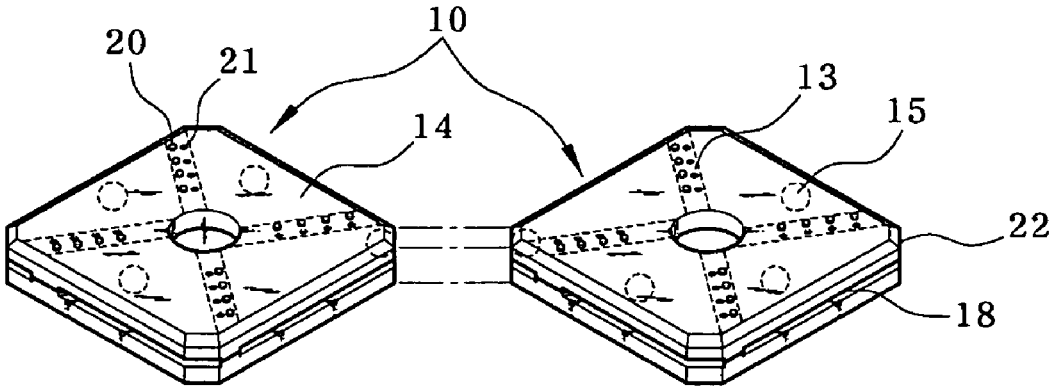
Figure 10C:
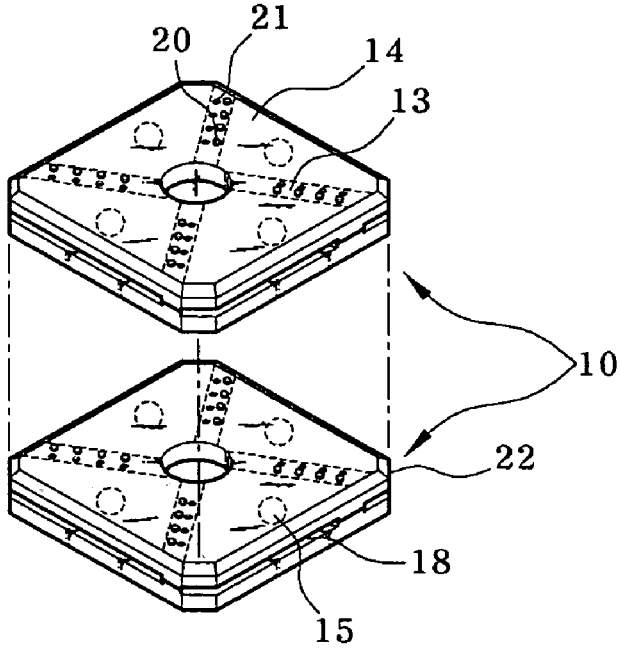

In the panel-type magnetic toy constructed as described above, each of the partition walls 13 radially extending from the center of the panel body 11, namely, the rod insertion hole 12, is arranged so that the outside end of the partition wall 13 is biased to one side of each corner of the panel body 11. Such a construction allows the magnet 15 in each compartment 14 to move to a corner 22. Thereby, it is possible to connect the corner of one panel body 11 to the corner of another panel body 11. In this case, each corner 22 of the panel body 11 where the horizontal contact parts 17*a* and 17*b* meet each other is chamfered FIGS. 10A to 10*c* are perspective views to show various coupling structures of the panel-type magnetic toy, according to this invention, in which FIG. 10A is a perspective view to show the state where the side of one panel is coupled to the side of another panel, FIG. 10B is a perspective view to show the state where the corner of one panel is coupled to the corner of another panel, and FIG. 10C is a perspective view to show the state where the face of one panel is coupled to the face of another panel. FIGS. 11A to 11D are front views to show various shapes of panels of the panel-type magnetic toy, according to the present invention.

The panel-type magnetic toy according to the present invention is constructed so that the magnets 15 are present in the compartments 14 partitioned by the partition walls 13 which are provided in the panel body 11. Thus, as neighboring panels 10 approach each other, the magnets 15 of the panels 10 roll. For example, as shown in FIG. 10A, when the side of the panel body 11 approaches the side of another panel body 11, the spherical magnets 15 in adjacent compartments 14 roll to corresponding positions. At this time, an attractive force acts between the spherical magnets 15 of the neighboring panel bodies 11, so that the side of the panel body 11 is connected to the side of the other panel body 11.

Further, as shown in FIG. 10B, when two panel bodies 11 move so that the corner 22 of one panel 10 approaches the corner 22 of the other panel 10, an attractive force is generated between the spherical magnets 15 that roll to the corresponding corners 22 of the panel bodies 11. Thereby, the corner of one panel 10 is connected to the corner of the other panel 10. Meanwhile, as shown in FIG. 10C, the panels 10 having the same shape are placed so that the front surface of one panel body 11 contacts the back surface of another panel body 11. Further, the protrusions 20 and the holes 21 radially arranged along the partition walls 13 of one panel 10 engage with the holes 21 and the protrusions 20 of the other panel 10. At this time, the spherical magnets 15 in the compartments 14 of neighboring panels 10 move to the same positions, due to attractive force acting between the spherical magnets 15 of the panels 10. Thereby, the face of one panel 10 is connected to the face of another panel 10.

As such, neighboring panels 10 are connected to each other, due to the magnetic force of the magnets 15 moving in the compartments 14 of the panel bodies 11. In this case, the side of one panel 10 may be connected to the side of another panel 10, or the corner of one panel 10 may be connected to the corner of another panel 10, or the surface of one panel 10 may be connected to the surface of another panel 10. Such a panel 10 includes a panel body 11 having various shapes, for example, a triangular shape, a rectangular shape, a right-angled triangular shape, or a pentagonal shape, as shown in FIG. 11. The panels 10 having various shapes are combined with each other, thus providing three-dimensional structures having various shapes.

Figure 12:
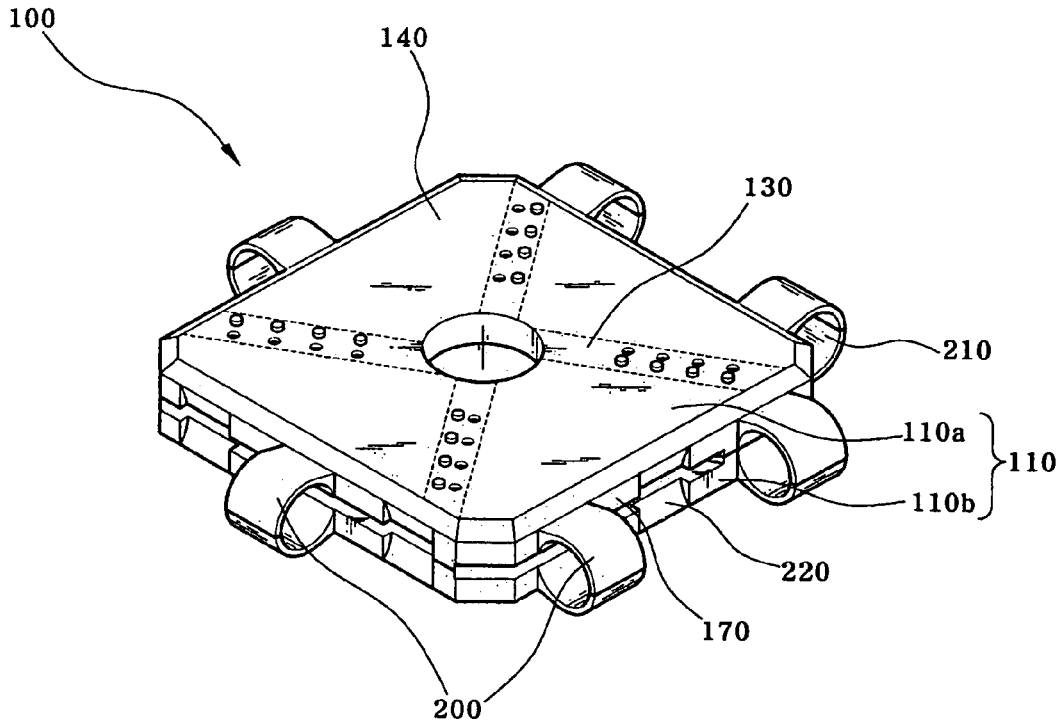
FIG. 12 is a perspective view to show a panel of a panel-type magnetic toy, according to another embodiment of the present invention.
Figure 13:
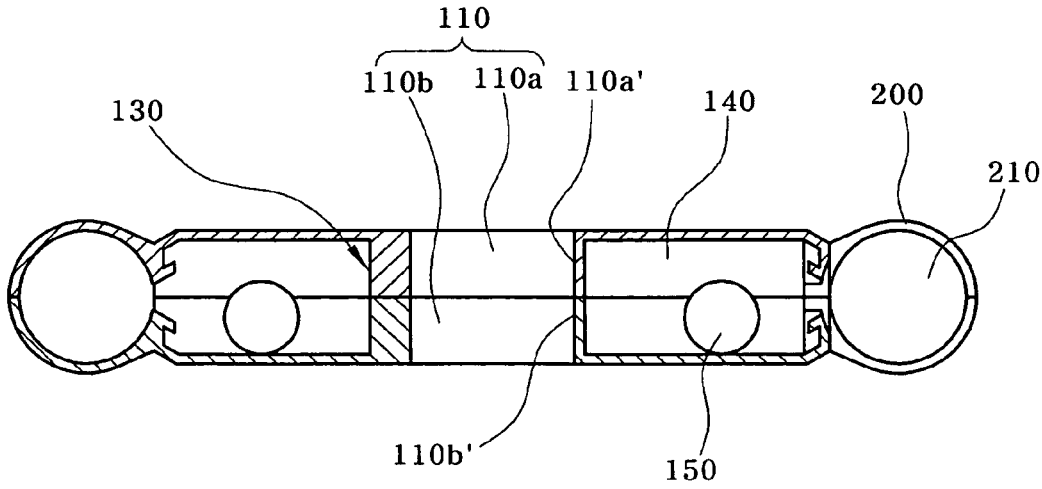
FIG. 13 is a sectional view of the panel of FIG. 12.
Figure 14:
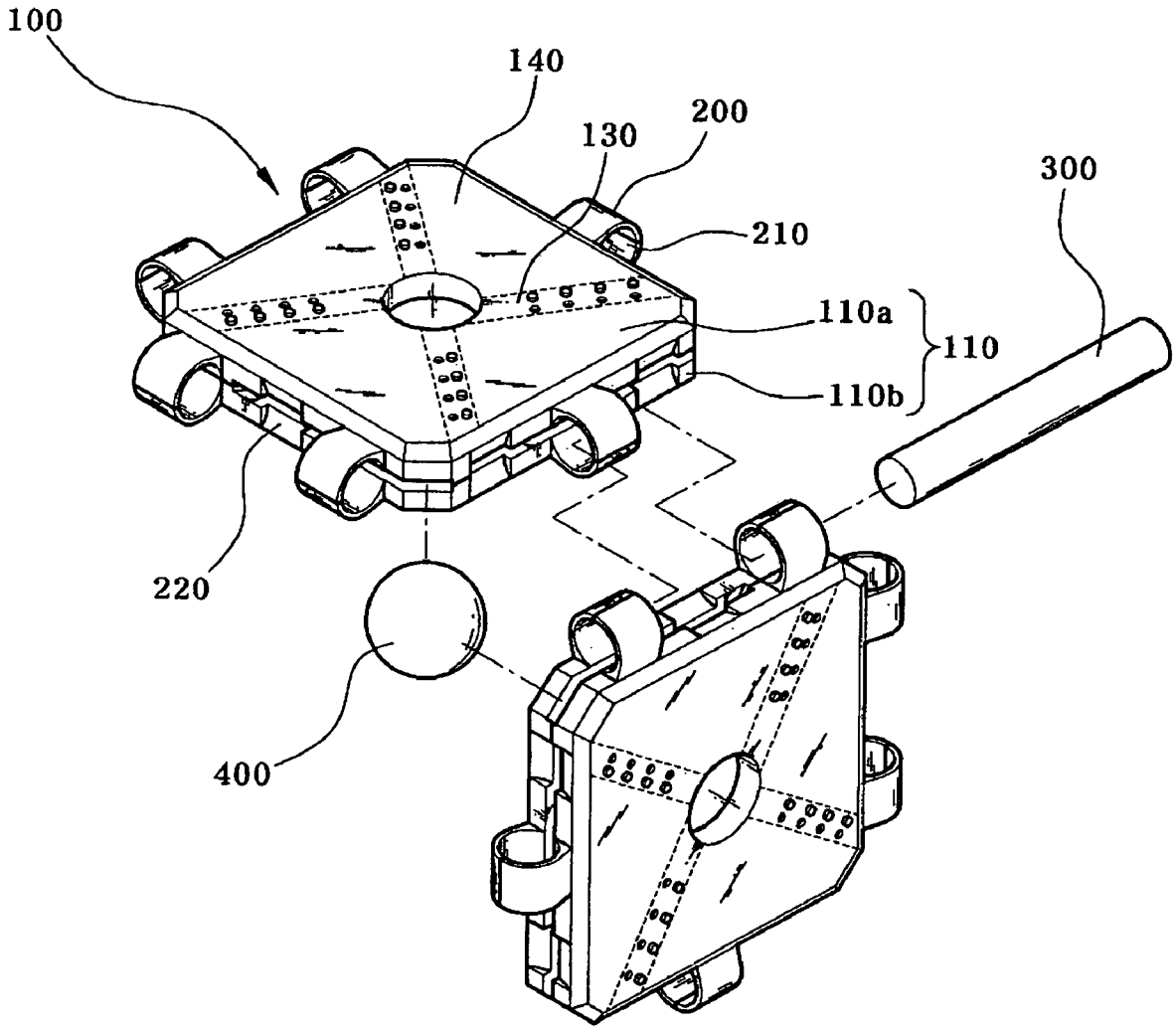
FIG. 14 is a perspective view to show the combination of the panels of FIG. 12.

FIGS. 12 to 14 are views to show a panel, according to another embodiment of the present invention. FIG. 12 is a perspective view of the panel, according to another embodiment of the present invention, FIG. 13 is a sectional view of the panel of FIG. 12, and FIG. 14 is a perspective view to show the combination of two panels.

As shown in the drawings, the panel 100 of this embodiment includes a panel body 110. The panel body 110 has upper and lower panel parts 110*a* and 110*b*. Ribs 110*a*' and 110*b*', which are radially provided on a surface of the upper panel part 110*a* and a surface of the lower panel part 10*b*, respectively, are combined with each other, thus forming partition walls 130. The panel body 110 is partitioned into hollow compartments 140 by the partition walls 130, and spherical magnets 150 are movably put into the hollow compartments 140. According to this embodiment, at least one cylindrical rod support 200 is provided on a horizontal contact part 170 constituting each side surface of the panel body 110, and extends horizontally from the panel body 110. Further, a rod insertion hole 210 is bored through the center of the rod support 200.

Further, according to this embodiment, a concave curved part 220 is provided at a predetermined position on the horizontal contact part 170 of the panel body 110, and has the same curvature as the rod support 200. Thereby, when two panels 100 are combined with each other, the outer circumference of the rod support 200 of one panel 100 is in close contact with the side surface of another panel 100. At this time, the rod supports 200 of the two panels 100 are alternately arranged.

Preferably, the width of the concave curved part 220 is equal to or slightly larger than the width of the rod support 200.

Meanwhile, a cylindrical rod 300 is fitted into the rod insertion hole 210 of the rod support 200 which is provided on each side surface of the panel body 110. Thus, when the two panels 100 are combined with each other using the cylindrical rod 300, the panels 100 can rotate about the cylindrical rod 300.

As described above, the present invention provides a panel-type magnetic toy, including a panel body made by coupling polygonal upper and lower panel parts to each other, hollow compartments partitioned by partition walls formed by coupling ribs radially provided on the upper and lower panel parts to each other, and spherical magnets put into the compartments of the panel body and rolling due to external magnetic force or gravity. As the magnets roll in the hollow compartments partitioned by the partition walls, attractive force is generated between the magnets of neighboring panels. Thereby, it is possible to connect the panels to each other at various positions. Since the magnets move according to the contact position of the panels, it is possible to manufacture variously shaped structures using a small number of panels, thus increasing the creative potential.

What is claimed is:

1. A panel-type magnetic toy, comprising:

a polygonal panel body having a space therein;

a plurality of compartments defined in the space of the panel body and separated from each other by at least one partition wall; and a permanent magnet movably provided in each of the compartments;

wherein the panel body comprises upper and lower panel parts having the same shape; and wherein each of the upper and lower panel parts comprises:

a horizontal contact part bent perpendicularly from a side edge of each of the upper and lower panel parts; and a tapered surface formed along an edge of the horizontal contact part and inclined at a predetermined angle.

2. The panel-type magnetic toy according to claim 1, wherein the horizontal contact parts of the upper and lower panel parts meet each other at a corner of the panel body, the corner of the panel body being chamfered.

3. A panel-type magnetic toy comprising:

a polygonal panel body having a space therein;

a plurality of compartments defined in the space of the panel body and separated from each other by at least one partition wall; and a permanent magnet movably provided in each of the compartments;

wherein an opening is longitudinally provided on a side surface of each of the compartments, excluding a portion corresponding to an outside end of the partition wall; and wherein the panel body includes a horizontal contact part bent perpendicularly from a side edge of the panel body, and wherein the opening comprises a space defined by a bent part that is bent inwards from an end of the horizontal contact part, the bent part being at an acute angle with an inner surface of the horizontal contact part.

4. A panel-type magnetic toy, comprising:

a polygonal panel body having a space therein;

a plurality of compartments defined in the space of the panel body and separated from each other by at least one partition wall; and a permanent magnet movably provided in each of the compartments;

wherein protrusions and holes are provided on upper and lower surfaces of the panel body and are parallel with each other, the protrusions and holes being arranged along the partition wall.

* * * * *